United States Patent [19]

Pickering

[11] Patent Number: 4,619,604

[45] Date of Patent: Oct. 28, 1986

[54] FLAME RADIATOR STRUCTURE

[75] Inventor: Mark A. Pickering, Lebanon, Ind.

[73] Assignee: Carrier Corporation, Syracuse, N.Y.

[21] Appl. No.: 757,755

[22] Filed: Jul. 22, 1985

Related U.S. Application Data

[63] Continuation of Ser. No. 509,552, Jun. 30, 1983, abandoned.

[51] Int. Cl.[4] ..... F23D 14/02

[52] U.S. Cl. ..... 431/353; 431/352; 126/91 A

[58] Field of Search ..... 431/353, 352, 351, 349, 431/347, 284, 243, 114; 110/235, 253; 126/91 A, 99 R, 92 R; 60/725, 738, 739, 749

[56] References Cited

U.S. PATENT DOCUMENTS

| | | | |
|---|---|---|---|
| 2,455,115 | 11/1948 | Larcey | 431/201 |
| 2,758,636 | 8/1956 | Hubbard | 431/353 |
| 3,545,202 | 12/1970 | Batt et al. | 431/352 |
| 3,706,203 | 12/1972 | Goldberg et al. | 431/353 |
| 3,828,762 | 8/1974 | Duzey | 126/91 A |
| 3,854,503 | 12/1974 | Nelson | 431/352 |
| 4,149,842 | 4/1979 | Benjamin | 431/352 |
| 4,162,611 | 7/1979 | Carvel et al. | 431/353 |
| 4,187,835 | 2/1980 | Finney | 431/352 |
| 4,231,735 | 11/1980 | Downs | 431/353 |
| 4,295,821 | 10/1981 | Schilling | 431/353 |
| 4,465,457 | 8/1984 | Ishikawa et al. | 431/201 |
| 4,484,886 | 11/1984 | Nakamura et al. | 431/198 |

FOREIGN PATENT DOCUMENTS

| | | | |
|---|---|---|---|
| 6515979 | 6/1967 | Netherlands | 431/353 |

*Primary Examiner*—Samuel Scott
*Assistant Examiner*—H. A. Odar
*Attorney, Agent, or Firm*—Robert H. Kelly

[57] ABSTRACT

A flame radiator structure is disclosed for inhibiting formation of oxides of nitrogen ($NO_x$) by a combustion system of the type having at least one monoport inshot burner which burns fuel to produce a combustion flame which is projected through an inlet opening into a heat exchanger for the combustion system. The flame radiator structure comprises a perforated, tubular, main body section having open ends and means for attaching this perforated tubular main body section at the inlet to the heat exchanger. Alternating ribs and oblong openings are spaced along side walls of the perforated main body section to stiffen the structure and to allow the structure to safely expand and contract in response to thermal cycling. The flame radiator structure is sized, configured, and positioned relative to the combustion flame produced by the monoport inshot burner to temper the flame by absorbing thermal energy from the combustion flame at a rate which limits peak flame temperatures and residence times at these peak flame temperatures to levels which inhibit formation of $NC_x$ while allowing substantially complete combustion of the fuel supplied to the burner.

6 Claims, 4 Drawing Figures

FLAME RADIATOR STRUCTURE

This application is a continuation of application Ser. No. 509,552, filed June 30, 1983, now abandoned.

BACKGROUND OF INVENTION

The present invention relates to combustion systems and, more particularly, relates to devices for inhibiting formation of oxides of nitrogen ($NO_x$) by combustion systems.

As a result of the combustion process, combustion systems normally generate gaseous combustion products which include oxides of nitrogen ($NO_x$) which are vented to atmosphere as flue gas. It is desirable to limit these $NO_x$ emissions since $NO_x$ is considered a pollutant and combustion systems sold in certain jurisdictions must meet strict $NO_x$ emmission standards.

A novel technique for limiting $NO_x$ emissions from a combustion system is disclosed in copending U.S. patent application Ser. No. 509,504 filed June 30, 1983 abandoned, filed as continuation in Ser. No. 761,336 entitled "A Device For Inhibiting $NO_x$ Formation by a Combustion System" with Chester D. Ripka, et al. as inventors. According to this novel technique, $NO_x$ emissions from a combustion system are limited by providing the combustion system with a special device at each burner location to inhibit formation of $NO_x$ by the combustion system. The special device is a piece of material which is sized, configured, and positioned relative to the combustion flame produced by the burner to temper the combustion flame by absorbing thermal energy from the combustion flame. The device is designed to absorb thermal energy from the combustion flame at a rate which limits peak flame temperatures and residence times at these peak flame temperatures to levels which inhibit formation of $NO_x$, while allowing substantially complete combustion of fuel supplied to the burner.

A device of the type described above may be used to limit $NO_x$ emissions from a combustion system such as a gas-fired furnace having monoport inshot burners which each burn fuel to form a combustion flame which is projected through an inlet opening into a heat exchanger for the combustion system. However, if the furnace is frequently cycled on and off, then the device must be able to withstand frequent thermal cycling from room temperatures to combustion temperatures without breaking, bending, cracking or otherwise mechanically failing. Also, to ensure that the combustion process of the furnace is not adversely affected by the presence of the device, the device should not adversely interfere with the flow of products of combustion away from the combustion zone for each burner. Further, the device should be relatively easy and inexpensive to manufacture and easy to install, so that the device is practical from a cost-effectiveness viewpoint and so that the device is suitable for retrofitting furnaces having such monoport inshot burners.

SUMMARY OF THE INVENTION

Therefore, it is an object of the present invention to provide a relatively durable device for inhibiting $NO_x$ formation by a combustion system of the type having monoport inshot burners which each burn fuel to form a combustion flame which is projected through an inlet opening into a heat exchanger for the combustion system.

It is another object of the present invention to provide a relatively easy to manufacture, easy to install, and inexpensive device for inhibiting $NO_x$ formation by a combustion system of the type having monoport inshot burners which each burn fuel to form a combustion flame which is projected through an inlet opening into a heat exchanger for the combustion system.

It is a further object of the present invention to provide an efficient and effective device for inhibiting $NO_x$ formation by a combustion system of the type having monoport inshot burners which each burn fuel to form a combustion flame which is projected through an inlet opening into a heat exchanger for the combustion system.

It is a still further object of the present invention to provide a device for inhibiting $NO_x$ formation which is suitable for retrofit applications in a combustion system of the type having monoport inshot burners which each burn fuel to form a combustion flame which is projected through an inlet opening into a heat exchanger for the combustion system.

According to the present invention, these and other objects are attained by providing a combustion system of the type having monoport inshot burners which each burn fuel to form a combustion flame which is projected through an inlet opening into a heat exchanger for the combustion system, with a flame radiator structure at each burner location. The flame radiator structure comprises a perforated, tubular, main body section having open ends with perforated flanges extending from one end of the body section for attaching the body section at the inlet to one of the heat exchangers of the combustion system. The main body section includes ribs for stiffening the structure and oblong openings for allowing expansion and contraction of the structure without mechanical failure in response to thermal cycling.

The flame radiator structure is sized, configured, and positioned relative to the combustion flame produced by the monoport inshot burner to temper the combustion flame by absorbing thermal energy from the combustion flame at a rate which limits peak flame temperatures and residence times at these peak flame temperatures to levels which inhibit formation of $NO_x$ while allowing substantially complete combustion of the fuel supplied to the burner. Preferably the perforations in the main body section and in the flanges of the flame radiator structure are sized so that the structure does not significantly interfere with the flow of combustion products away from the combustion flame. Also, preferably the flame radiator structure is configured and made of a material so that the structure radiates the thermal energy which it absorbs from the combustion flame to the walls of the heat exchanger surrounding the structure so that this thermal energy may be efficiently utilized by the furnace.

BRIEF DESCRIPTION OF THE DRAWING

Other objects, features, and advantages of the present invention will be apparent from the following detailed description in conjunction with the accompanying drawing, in which like reference numerals identify like elements, and in which.

DESCRIPTION OF THE PREFERRED EMBODIMENT

Figure 1:
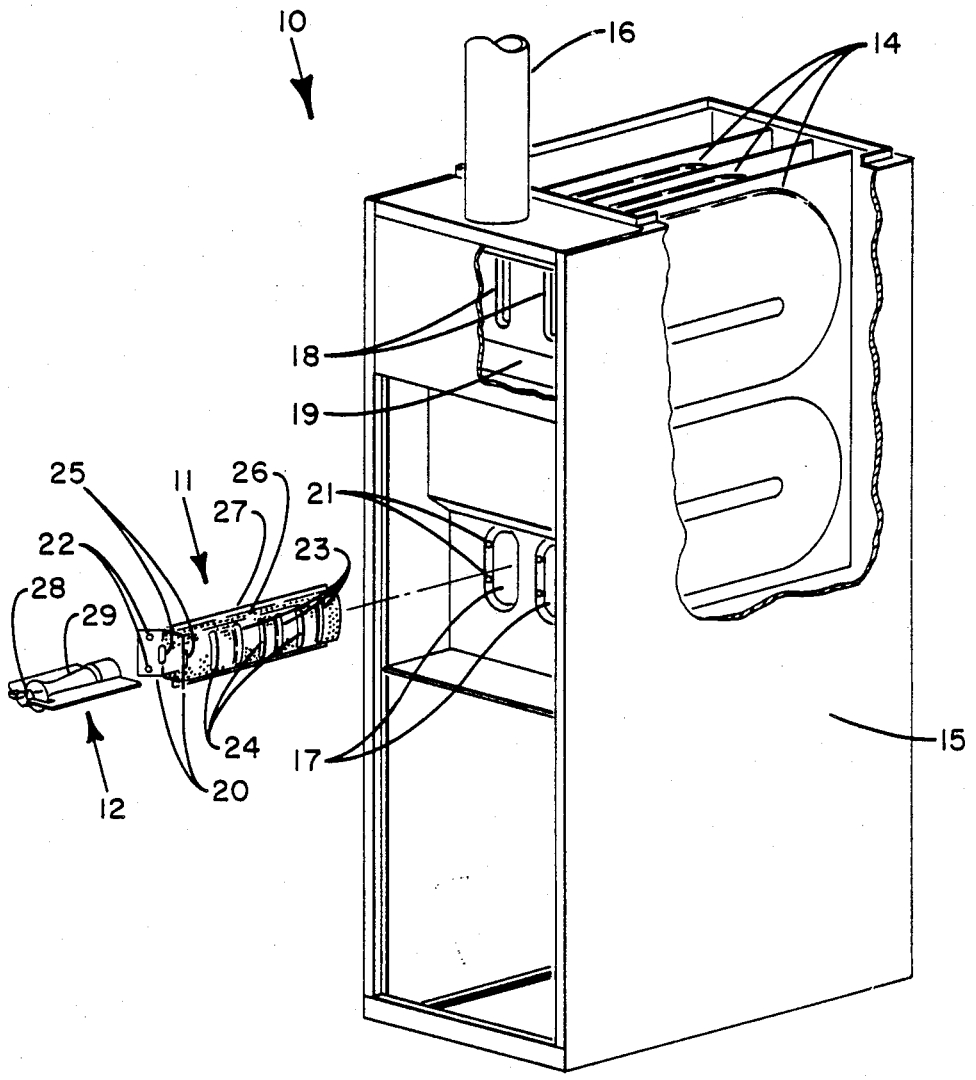
FIG. 1 shows a partially exploded and cut-away view of a gas-fired furnace 10 having a monoport inshot burner 12 and a flame radiator structure 11 for inhibiting $NO_x$ formation by this type of combustion system according to the principles of the present invention.

Referring to FIG. 1, a partially exploded and cutaway view is shown of a gas-fired furnace 10 having a monoport inshot burner 12 and a flame radiator structure 11 for inhibiting $NO_x$ formation by this type of combustion system according to the principles of the present invention. As shown in FIG. 1, the flame radiator structure 11 is a perforated tubular structure having a generally rectangular cross-section which will be described in more detail hereinafter. In addition to the flame radiator structure 11 and the burner 12, the gas-fired furnace 10 includes heat exchangers 14, a furnace cabinet 15, and a flue pipe 16. Each of the heat exchangers 14 is a S-shaped, four-pass heat exchanger having an inlet opening 17 through which a combustion flame may be projected from a burner. Also, each of the heat exchangers 14 has an outlet opening 18 through which flue gases are discharged from the heat exchanger into a flue gas collection chamber 19 from which the flue gases pass into the flue pipe 16 to flow out of the furnace 10.

For ease of illustration, only three heat exchangers 14 are shown in FIG. 1 and only one of the heat exchangers 14 is shown with a burner 12 and a flame radiator structure 11. However, it is to be understood that the furnace 10 may have any number of heat exchangers 14 each with its own burner 12 and flame radiator structure 11.

When assembled in the gas-fired furnace 10, the flame radiator structure 11 is located just inside the mouth of the heat exchanger 14 and is held in this position by any suitable means. Preferably, as shown in FIG. 1, the flame radiator structure 11 has mounting flanges 20 with openings 22 for accomodating bolts (not shown) which are inserted and screwed into corresponding openings 21 in the lip of the heat exchanger 14 surrounding the inlet opening 17.

The monoport inshot burner 12 includes a spout 28 for injecting fuel into body portion 29 of the burner 12. The burner 12 is held in position just outside the inlet opening 17 to the heat exchanger 14 by any suitable means (not shown). The burner 12 faces the inlet opening 17 to project a combustion flame generally into the center of the flame radiator structure 11 when the burner 12 is operating. Fuel is supplied through the spout 28 to the body portion 29 of the burner 12 by any suitable means (not shown).

Figure 4:
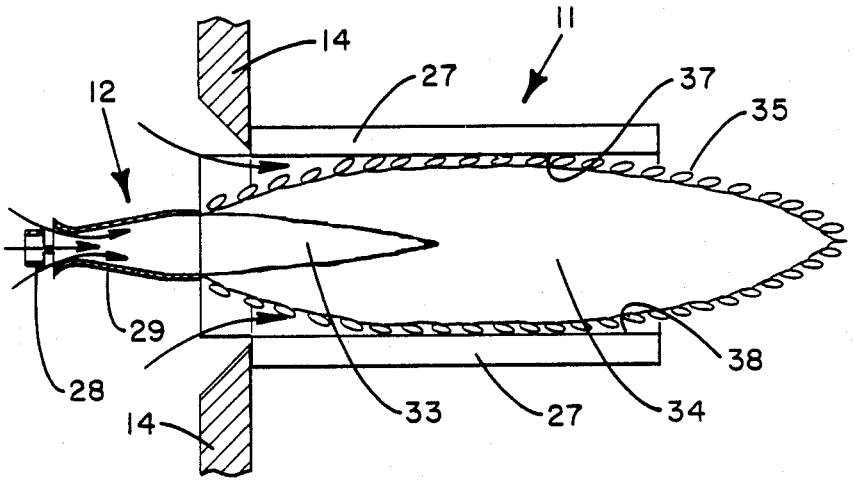
FIG. 4 is a cross-sectional view of the burner 12 and flame radiator structure 11 shown in FIG. 1 when the burner 12 and flame radiator structure 11 are assembled in the furnace 10.

As best understood by referring to FIG. 4, the monoport inshot burner 12 is a two-zone combustion type burner. This means that the burner 12 utilizes non-stoichiometric combustion wherein the combustion is divided into two distinct zones. As shown by FIG. 4, the spout 28 injects fuel into the body portion 29 of the burner 12 and primary combustion air is simultaneously drawn into and mixed with the fuel in the body portion 29 of the burner 12 to form a fuel rich mixture which is burned to create a primary combustion zone 33.

Normally, the primary combustion zone 33 is characterized by a relatively intense, bluish flame which is projected from the burner 12. Then, the remaining unburned fuel from the primary combustion zone 33 is brought into contact with secondary air at some point downstream of the primary combustion zone 33 to burn the remaining fuel to create a secondary combustion zone 34. Actually, the secondary air diffuses into the secondary combustion zone 34 to form a diffusion layer wherein most of the combustion occurs at the interface of the secondary air and the unburned fuel from the primary combustion zone 33 at periphery 35 of the combustion flame. Thus, normally, there are regions at the periphery 35 of the combustion flame having relatively high peak flame temperatures. Also, eddies of near-stoichiometric mixtures of fuel and air are likely to be formed at the periphery 35 of the combustion flame because of the mixing of the secondary air and the products of combustion from the primary combustion zone 33 at the periphery 35 of the combustion flame. These eddies swirl about the periphery 35 of the combustion flame thereby creating regions of the combustion flame having relatively long residence times at the relatively high peak combustion flame temperatures. This is undesirable with respect to $NO_x$ formation because it is known that, in general, $NO_x$ is formed when combustion substances are maintained for relatively prolonged periods of time at such relatively high peak combustion flame temperatures.

According to the present invention, undesirable formation of $NO_x$ by the furnace 10 is inhibited by the presence of the flame radiator structure 11 which tempers the combustion flame produced by the burner 12 by absorbing thermal energy from the combustion flame. The flame radiator structure 11 limits peak flame temperatures and residence times at these peak flame temperatures, in certain selected regions of the combustion flame, to levels which inhibit formation of $NO_x$ while allowing substantially complete combustion of the fuel supplied to the burner 12. The overall amount of $NO_x$ is limited to a desired, selected level by limiting the peak flame temperatures and residence times at these peak flame temperatures in enough regions of the combustion flame to achieve the desired level of $NO_x$ emissions.

Of course, different regions of the combustion flame have different peak flame temperatures and different residence times at these peak flame temperatures depending on their location in the combustion flame. Normally, the temperature of a given region of the combustion flame will vary within a certain temperature range as a function of time during any time period of operation of the burner 12 and will remain at the peak flame temperature within this temperature range for a certain amount of time (residence time) during this time period of operation of the burner 12. Throughout this patent application the terms "peak flame temperature" and "residence time at a peak flame temperature" are used in reference to a given region of the combustion flame and the plurals of these terms are used to collectively refer to several of these regions.

It has been found that a desirable location for the flame radiator structure 11 relative to the combustion flame produced by a two-zone combustion type burner, such as the monoport inshot burner 12 shown in the Figures, is at the periphery 35 of the combustion flame where the structure 11 is able to efficiently and effectively reduce peak flame temperatures and residence times at these peak flame temperatures to desired levels. The periphery 35 of the combustion flame is a desirable location for the flame radiator structure 11 because, as discussed above, the periphery 35 of the combustion flame is the location where there are regions of the combustion flame having relatively high peak flame temperatures and relatively long residence times at these relatively high peak flame temperatures. In fact, it has been observed that if a flame radiator structure 11 is moved a small distance away from the periphery 35 of the combustion flame the structure 11 is substantially less effective in inhibiting $NO_x$ formation compared to when the structure 11 is located at the periphery 35 of the combustion flame. However, in certain situations, desired performance goals may be achieved by positioning the flame radiator structure 11 within the primary combustion zone 33 or at some other position relative to the combustion flame other than at the periphery 35 of the combustion flame.

Also, as best shown by FIG. 4, preferably, the flame radiator structure 11 is positioned and configured relative to a selected portion of the periphery 35 of the combustion flame produced by the burner 12 so that the flame radiator structure 11 is adjacent to and in contact with the outer surface of the selected portion of the periphery 35 of the combustion flame. Of course, normally, the periphery 35 of the combustion flame will randomly fluctuate in location throughout any time period of operation of the burner 12. Therefore, for a combustion flame projected from any particular burner 12, it is desirable to determine the average location of the periphery 35 of the combustion flame by observing the combustion flame during operation of the burner 12, and to position and configure the flame radiator structure 11 relative to this average location of the periphery 35 of the combustion flame. Thus, in this patent application, when it is stated that the flame radiator structure 11 is positioned "at" the periphery 35 of the combustion flame this means that the flame radiator structure 11 is positioned relative to the average location of the periphery 35 of the combustion flame so that when the burner 12 is operating the periphery 35 of the combustion flame randomly fluctuates about the position of the flame radiator structure 11.

Of course, a different location for the flame radiator structure 11 may be preferred relative to a combustion flame produced by another type of burner. For example, for a single-zone combustion type burner having only a primary combustion zone 33 it may be preferable to locate the structure 11 within the primary combustion zone 33 or at the periphery of the primary combustion zone 33. Also, in another type of combustion system it may be desirable to use a device having a structural design different than the structural design of the preferred flame radiator structure 11 shown in the FIGS. 1, 2, and 3.

Also, it should be noted that the flame radiator structure 11 is sized, configured, and made of a material having physical properties, such as coefficient of thermal conductivity and radiation characteristics (that is characteristics such as the rate at which the material will radiate heat energy to its surroundings at certain elevated temperatures), so that the structure 11 tempers the combustion flame produced by the burner 12 by absorbing thermal energy from the combustion flame at a selected rate. The size of the flame radiator structure 11 is important because the amount of thermal energy absorbed from the combustion flame depends on the mass of the structure 11. Larger, more massive structures, are generally capable of absorbing more thermal energy from the combustion flame than smaller, less massive structures. Of course, in this regard, the configuration of the flame radiator structure 11 is also an important consideration. A relatively thin structure 11 is capable of absorbing thermal energy from the combustion flame and then radiating this energy to its surroundings. In contrast, a relatively thick structure 11 may not be capable of radiating away much of its absorbed thermal energy. Thus, in certain situations a relatively thin structure 11 with good radiation characteristics may absorb thermal energy from the combustion flame at a faster rate than a relatively thick structure 11 which can only thermally conduct heat away from the combustion flame.

Also, as will be readily apparent to one of ordinary skill in the art to which the present invention pertains, the physical properties of the material from which the structure 11 is made are very important relative to the ability of a structure to absorb and radiate thermal energy. Some materials are able to absorb and radiate thermal energy faster and more efficiently than other materials. In certain applications, such as a gas-fired furnace application, it is desirable to utilize the available thermal energy in the most efficient manner possible. Therefore, it is preferable in such a furnace application to use a structure 11 having a thickness which will allow the structure 11 to radiate absorbed thermal energy to its surroundings, namely to the walls of a heat exchanger surrounding the structure 11, so that the available thermal energy may be efficiently utilized by the furnace.

Also, preferably, in a furnace application wherein a two-zone combustion type burner, such as the monoport inshot burner 12 shown in the Figures, is utilized, the flame radiator structure 11 is configured and positioned to aerodynamically smooth at least a portion of the combustion flame at the periphery 35 of the combustion flame to inhibit formation of the near-stoichiometric eddies of secondary air and fuel which form at the periphery 35 of the combustion flame. By smoothing the periphery 35 of the combustion flame, fewer of these eddies are formed thereby minimizing $NO_x$ formation by reducing residence times at the peak flame temperatures.

In addition to the considerations discussed above, in a furnace application of the kind described above, durability and efficiency of the flame radiator structure 11 are important considerations. For example, in such gas-fired furnace applications, the material from which the flame radiator structure 11 is made must be capable of being cycled many times from normal room temperatures to relatively high combustion flame temperatures without being severely damaged by oxidizing, corroding, breaking, bending, cracking or being damaged in other ways due to this thermal cycling. Also, the ability of the material to reradiate absorbed thermal energy is important with respect to overall efficiency of the furnace. In these applications, it has been found that metallic materials, such as stainless steel, and other steel alloys which are resistant to oxidation at relatively high combustion flame temperatures are particularly suitable materials from which to make the flame radiator structure 11. More specifically, American Iron and Steel Institute (AISI) designated types 310, 314, and 330 stainless steel, and nichrome (60 Ni, 16 Cr alloy specified in the American Society for Testing and Materials (ASTM) "Standard Specification for Drawn or Rolled Nickel-Chromium and Nickel-Chromium-Iron Alloys for Electrical Heating Elements" as B344) have been found to be suitable materials from which to make the flame radiator structure 11. Types 310 and 314 stainless steel appear especially desirable materials from a cost-effectiveness viewpoint.

Figure 2:
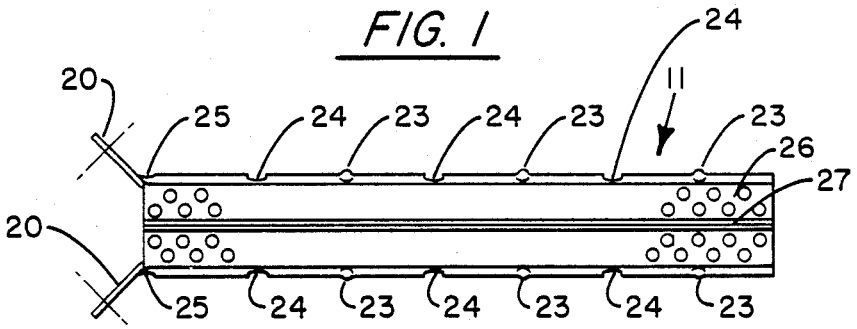
FIG. 2 is a top view of the flame radiator structure 11 shown in FIG. 1.
Figure 3:
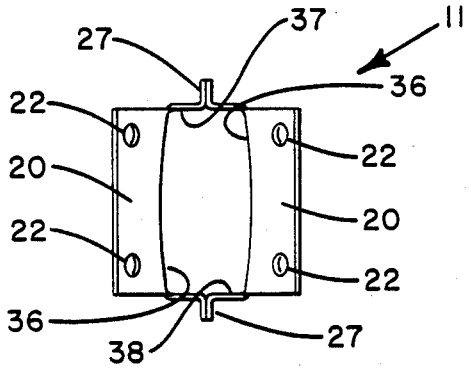
FIG. 3 is an end view of the flame radiator structure 11 shown in FIG. 1.

Durability of the flame radiator structure 11 also depends on the configuration of the structure 11. For example, it has been found that a flame radiator structure 11 made of type 310 stainless steel and having the special configuration shown in FIGS. 1, 2, and 3, is especially durable when used in a gas-fired furnace 10 of the type shown in FIG. 1. As shown in FIGS. 1, 2, and 3, this specially configured flame radiator structure 11 comprises a perforated tube 26 having a generally rectangular cross-section. The tube 26 is open at both ends with mounting flanges 20 extending from one end of the tube 26 for attaching the flame radiator structure 11 at the lip surrounding the inlet opening 17 to one of the heat exchangers 14 in the furnace 10 as described previously. There are alternating ribs 23 and oblong openings 24 along each side wall 36 of the tube 26 which are approximately equidistantly spaced apart from each other. Each of the ribs 23 and openings 24 is oriented generally perpendicular to the longitudinal axis of the tube 26 and extends substantially from the top to the bottom of the side wall 36 of the tube 26. Also, there is an additional oblong opening 25 in the tube 26 at each boundary between a mounting flange 20 and a side wall 36 of the tube 26. Each of these additional oblong openings 25 has a length of approximately one-half the height of the side wall 36, is oriented generally perpendicular to the longitudinal axis of the tube 26, and is approximately centered in the side wall 36 of the tube 26.

The ribs 23 on the tube 26 stiffen the flame radiator structure 11 and aid in preventing the structure 11 from bending into the combustion flame produced by the burner 12. Also, as best shown in FIG. 3, the tube 26 may have side walls 36 which are bowed slightly outward to bias the side walls 36 of the structure 11 to bend outward away from the combustion flame even if some bending of the structure 11 does occur due to thermal cycling. This aids in preventing subjection of the flame radiator structure 11 to the higher, more destructive temperatures associated with the primary combustion zone 33 of the combustion flame even if some bending of the structure 11 does occur, thereby improving the durability of the structure 11. In addition, longitudinal flanges 27 on the top wall 37 and bottom wall 38 of the tube 26 aid in keeping the tube 26 rigid and stable. The oblong openings 24 and 25 in the side walls 36 of the tube 26 aid in allowing the flame radiator structure 11 to expand and contract without breaking, cracking or undergoing undesirable distortions in shape in response to thermal cycling.

In addition to durability, the special flame radiator structure 11 shown in FIGS. 1, 2, and 3 is easy to manufacture and install, is relatively inexpensive to build, and has many other desirable features and advantages. For example, the structure 11 may be easily manufactured by stamping out two flat pieces of sheet metal each of which is stamped out to form a perforated main body section and a perforated mounting flange 20 having oblong openings 24 and 25, and ribs 23. The stamped out flat pieces are then folded to form the top wall 37, bottom wall 38, and side walls 36 of the tube 26. These folded pieces may then be joined along the longitudinal flanges 27 to form the flame radiator structure 11 shown in the Figures. The folded pieces may be joined along each longitudinal flange 27 by spot welding or by any other suitable means of joining the pieces.

Also, it should be noted that the special flame radiator structure 11 shown in FIGS. 1, 2, and 3, has the desired feature of not interfering with the flow of products of combustion away from the combustion flame produced by the burner 12. The perforations in the walls of the tube 26 are sized so that the products of combustion may flow freely through the structure 11 away from the combustion flame while sufficient material is present in the structure 11 to achieve the desired tempering of the combustion flame.

In addition to the various alternatives discussed above, various other modifications and embodiments of the present invention will be readily apparent to one of ordinary skill in the art to which the present invention pertains. Therefore, while the present invention has been described in conjunction with particular embodiments, it is to be understood that various modifications and other embodiments of the present invention may be made without departing from the scope of the invention as described herein and as claimed in the appended claims.

I claim:

1. A combustion flame tempering device for a gas-fired furnace for inhibiting formation of oxides of nitrogen by a combustion system of the gas-fired furnace, the combustion system having at least one monoport inshot burner supplied with a gaseous fuel which is burned to produce the combustion flame which is projected through an inlet opening into an air heat exchanger for the gas-fired furnace, the combustion flame having a peripheral area of relatively high peak temperatures conductive to the formation of oxides of nitrogen, said combustion flame tempering device comprising:

a perforated tubular main body section having open ends and sidewalls, having top and bottom edges, said sidewalls having longitudinal flanges at the top and bottom edges thereof, said flanges keeping said tubular main body section rigid and stable, a plurality of ribs disposed on said sidewalls and being oriented generally perpendicular to the longitudinal flanges of said main body section, said ribs stiffening said sidewalls to prevent said main body section from bending relative to the combustion flame, a plurality of oblong openings disposed on said sidewalls in alternating fashion with said ribs and substantially paralleling said ribs, said oblong openings allowing said main body section to expand and contract during thermal cycling, said main body section being positioned generally at the peripheral area of the combustion flame where relatively high peak temperatures promote the formation of oxides of nitrogen, and being made of a temperature reducing material that absorbs heat energy from the peripheral area of the combustion flame to reduce the temperature of the flame below the high peak temperatures, thereby inhibiting the formation of oxides of nitrogen.

2. A combustion flame tempering device for inhibiting formation of oxides of nitrogen by a combustion system as recited in claim 1 wherein the perforations in the tubular main body section are sized so that the tubular main body section does not substantially interfere with flow of products of combustion away from the combustion flame.

3. A combustion flame tempering device for inhibiting formation of oxides of nitrogen by a combustion system as recited in claim 1 wherein the material composing the perforated tubular main body section comprises stainless steel.

4. A combustion flame tempering device for inhibiting formation of oxides of nitrogen by a combustion system as recited in claim 1 wherein the perforated tubular main body section comprises:

a generally rectangular cross-section with said side walls having said ribs and said oblong openings in alternating fashion, each of said ribs and oblong openings spaced an approximately equal distance apart from each other, each of said ribs and oblong openings oriented generally perpendicular to the longitudinal axis of said tube, and each of said ribs and oblong openings extending substantially from the top to the bottom of the side wall of said tube.

5. A combustion flame tempering device for inhibiting formation of oxides of nitrogen by a combustion system as recited in claim 4 further comprising means for attaching the perforated tubular main body section at the inlet opening to the heat exchanger for the combustion system comprising:

a pair of flanges, both extending from the same end of the perforated tubular main body section, which may be attached at the inlet opening to the heat exchanger so that the perforated main body section extends into the heat exchanger through the inlet opening; and an additional oblong opening located at a boundary formed between a flange and a side wall of the perforated tubular main body section, each of said additional oblong openings oriented generally perpendicular to the longitudinal axis of the perforated main tubular main body section, each of said additional oblong openings having a length of approximately one-half the side wall height, and each of said additional oblong openings approximately centered in the side wall of the perforated tubular main body section.

6. A combustion flame tempering device for inhibiting formation of oxides of nitrogen by a combustion system as recited in claim 5 wherein said sidewalls are bowed outwardly to bias said sidewalls away from the combustion flame.

* * * * *